US007536885B1

(12) United States Patent
Ross et al.

(10) Patent No.: US 7,536,885 B1
(45) Date of Patent: May 26, 2009

(54) BIMODAL DOOR SECURITY SYSTEM

(75) Inventors: Russell H. Ross, Dripping Springs, TX (US); Paul J. Haeck, New Braunfels, TX (US); Timothy C. Maleck, Manchaca, TX (US)

(73) Assignee: Detex Corporation, New Braunfels, TX (US)

( * ) Notice: Subject to any disclaimer, the term of this patent is extended or adjusted under 35 U.S.C. 154(b) by 258 days.

(21) Appl. No.: 11/356,932

(22) Filed: Feb. 17, 2006

(51) Int. Cl.
*E05B 65/10* (2006.01)

(52) U.S. Cl. ..... 70/92; 292/92; 292/251.5

(58) Field of Classification Search ..... 70/92; 292/21, 92, 190, 210, 251.5, 201
See application file for complete search history.

(56) References Cited

U.S. PATENT DOCUMENTS 3,677,043 A * 7/1972 Cox ..... 70/92
3,854,763 A * 12/1974 Zawadzki et al. ..... 292/201
4,652,862 A * 3/1987 Verslycken ..... 340/540
4,875,722 A * 10/1989 Miller et al. ..... 292/92
5,011,199 A * 4/1991 Lowe et al. ..... 292/92
5,035,450 A * 7/1991 Muller ..... 292/92
5,085,475 A * 2/1992 Austin et al. ..... 292/92
5,340,171 A * 8/1994 Slaybuagh et al. ..... 292/21
5,429,399 A * 7/1995 Geringer et al. ..... 292/92
5,479,151 A * 12/1995 Lavelle et al. ..... 340/542
5,823,582 A * 10/1998 Frolov et al. ..... 292/92
5,988,708 A 11/1999 Frolov et al.
6,048,000 A * 4/2000 Geringer et al. ..... 292/92
6,104,594 A * 8/2000 Frolov et al. ..... 361/152
6,386,597 B1 5/2002 Walsh, III
2002/0144525 A1 10/2002 Luker
2005/0104381 A1 5/2005 Whitaker et al.

* cited by examiner

*Primary Examiner*—Suzanne D Barrett
(74) *Attorney, Agent, or Firm*—Dillon & Yudell LLP

(57) ABSTRACT

A door exit device, security system, and method for implementing a delayed egress operating mode and an authorized access operating mode to control access through a door. In one embodiment, the exit device includes an egress enable mechanism including a latch retraction assembly operatively coupled between a push pad and a door latch. The latch retraction assembly retracts the door latch responsive to manual actuation of the push pad. The exit device further includes a delayed egress device having a latch retraction lock that is operatively coupled to the latch retraction assembly to prevent the latch retraction assembly from retracting the door latch coincident with an attempted manual actuation of the push pad. The exit device further includes an access enable device operatively coupled to actuate the latch retraction assembly in response to an authorized access signal. The delayed egress device further includes a lock override that, responsive to receiving the authorized access signal, releases the latch retraction lock to enable non-delayed retraction of the door latch.

21 Claims, 4 Drawing Sheets

BIMODAL DOOR SECURITY SYSTEM

BACKGROUND OF THE INVENTION

1. Technical Field

The present invention relates generally to door security systems, and in particular to a door exit device providing reliable, controlled access through a doorway. In particular, the present invention relates to an apparatus, system, and method for controlling access through a movable barrier, such as a door, in which signal actuated latch retraction functionality is integrated with a delayed egress mechanism.

2. Description of the Related Art

Door exit devices, also referred to as panic exits or fire exits, are typically operated from the inside of an outward swinging door and are designed to provide building occupants fast and easy egress in an emergency. A door exit device generally comprises a manually actuated latch release mechanism releasing a door latch responsive to a relatively minimal force applied in the direction of egress travel through the doorway. The manually actuated release mechanism includes a readily accessible push pad or crossbar rail extending at least halfway across the width of the door.

With safety of building occupants as its primary function, a door exit device must always release the door latch, allowing exit without special access authorization or significant door operation knowledge. Any minimally sufficient horizontal push force applied to the outer vertical surface of a push pad type exit device retracts the latch bolt and releases the door to be opened. Several exit device designs have been designed and utilized including rim type, vertical rod, and mortise lock type devices.

For a variety of security reasons, it is often necessary to provide a delayed egress system with exit doors. Delayed egress systems are characterized by a locking mechanism that delays latch retraction, and consequently egress through the door, for a specified period of time (usually between 15 and 30 seconds) following an initial attempt to push-actuate the exit device. Delayed egress provides added door access control by preventing an unauthorized exit for the specified delay period while an alarm is sounded, enabling security personnel to react to the attempted exit. Common delayed egress mechanisms include a solenoid-controlled push pad locking bar or an electromagnetic locking device that prevent opening the door independent of exit device latch retraction. Delayed egress devices are utilized in retail and grocery stores, assisted living communities, hospitals, airports and other security-conscious establishments to provide a requisite level of door access controllability together with the safety features of an emergency exit device.

Electric latch retraction is another access control feature that may be implemented with exit devices. Electric latch retraction devices utilize a remote authorization/unlocking mechanism to control egress and/or ingress through the door. Electric latch retraction is less susceptible to tampering and is therefore preferred over external lever-actuated trim which can be more easily breached. Common electric latch retraction design includes a solenoid to retract the latch bolt. Such devices are common in airports, hospitals, office buildings, etc., and are typically activated by card readers, touch pads, electronic keys or other personal identification security devices.

Delayed egress is utilized with many exit device implementations to maintain a level of controlled access while also providing the emergency exit functionality required by safety regulations. It is sometimes the case, however, that the security features associated with delayed egress such as alarms as well as the delay mechanism itself, pose an obstacle or at least a significant inconvenience when the doorway in question must be accessed by authorized personal. Such authorized access is often provided using electric outside trim, locking or electric strikes. These mechanisms are vulnerable to security and vandalism problems.

There remains a need for an exit device apparatus, system and method that efficiently and reliably integrates electric latch retraction with delayed egress functionality. The present invention addresses such a need and other needs not addressed by the prior art.

SUMMARY OF THE INVENTION

A door exit device, security system, and method for implementing a delayed egress operating mode and an authorized access operating mode to control access through a door are disclosed herein. In one embodiment, the exit device includes an egress enable mechanism including a latch retraction assembly operatively coupled between a push pad and a door latch. The latch retraction assembly retracts the door latch responsive to manual actuation of the push pad. The exit device further includes a delayed egress device having a latch retraction lock that is operatively coupled to the latch retraction assembly to prevent the latch retraction assembly from retracting the door latch coincident with an attempted manual actuation of the push pad. The exit device further includes an access enable device operatively coupled to actuate the latch retraction assembly in response to an authorized access signal. The delayed egress device further includes a lock override that, responsive to receiving the authorized access signal, releases the latch retraction lock to enable non-delayed retraction of the door latch.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF ILLUSTRATIVE EMBODIMENT(S)

The present invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention. Furthermore, when used and unless otherwise stated, the terms "vertical," "horizontal," "upper," "lower," "front," "back," "over," and "under," and similar position/orientation related terms are not to be construed as limiting the invention to a particular orientation. Instead, such terms are to be construed only on the relative basis depicted in the figures.

The present invention is directed to push pad type exit systems and devices that integrate an automatic latch retraction interface with delayed egress functionality. As described in further detail below with reference to the figures, the invention generally comprises a bimodal exit device operating in a steady state first mode, referred to herein as a delayed egress mode, in which a delay device maintains the exit device locked for a predetermined period following an attempt to manually actuate the exit device to open the door. The exit device switches to a transient second operating mode, referred to herein as an authorized access mode, in response to an access enable device receiving an authorized access identification input. Responsive to switching from the delayed egress mode to the authorized access mode, the door security system fully retracts the push pad to allow free access through the entry. In a preferred embodiment, the exit device is a push pad exit device comprising a door-mounted housing that extends a substantial portion of the door width.

Figure 1:
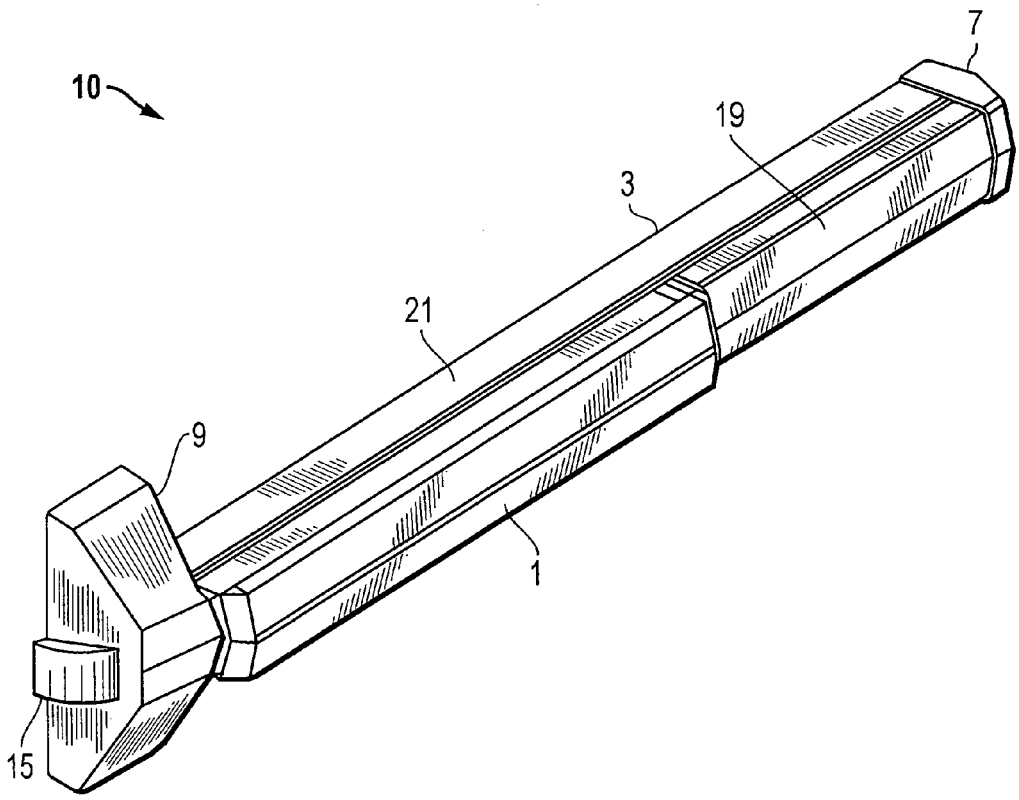
FIG. 1 depicts a perspective view of a door exit device in accordance with one embodiment of the present invention.

With reference now to the figures, wherein like reference numerals refer to like and corresponding parts throughout, and in particular with reference to FIG. 1, there is depicted a perspective view of a door exit device in the form of a rim latch push pad apparatus 10 in accordance with one embodiment of the present invention. As shown in FIG. 1, push pad apparatus 10 generally comprises an elongated housing member 3 adapted to be secured across a door surface and substantially spanning the width of the door (not depicted). While the embodiment depicted herein is a rim-latch type exit device, the present invention is also applicable to other exit device latching mechanisms such as surface or concealed vertical rod and mortise lock type devices. Push pad apparatus 10 includes latch retraction means including a push pad 1 that forms a substantial portion of the outside vertical surface of housing member 3. Push pad 1 is part of a manually actuated latch retraction mechanism that is mechanically linked to a door latch, depicted in FIG. 1 as a rim latch bolt 15, which is movably mounted adjacent the non-hinged edge of the door. Depressing push pad 1 in the direction of egress (i.e. toward the door) translates via mechanical linkage the force for actuating, via retraction, rim latch bolt 15, enabling opening of the door on which push pad apparatus 10 is mounted.

Housing member 3 further includes a latch housing 9 at one end and a cover plate 19 having an end cap 7 at the other end. A U-shaped metallic encasement 21 is mounted over a mounting plate frame 25 (depicted in FIGS. 2A and 2B). In accordance with standards requirements governing push-type exit devices, push pad 1 longitudinally spans a substantial portion of housing member 3 and defines a face for receiving a pushing force exerted toward the door by a person attempting to egress through the door.

As depicted and described below, push pad apparatus 10 includes a delayed egress device operatively coupled to lock the manually actuated latch retraction assembly during a delayed egress operating mode. Push pad apparatus 10 further includes a signal actuated latch retraction module operatively coupled to the manually actuated latch retraction assembly. An exemplary delayed egress device and signal actuated latch retraction module are depicted and described with reference to FIGS. 2A and 2B.

Figure 2A:
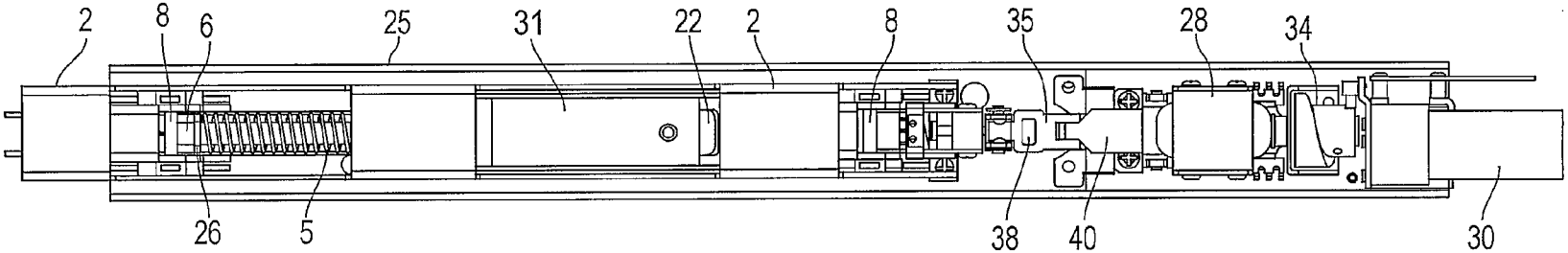
FIG. 2A illustrates a first cutaway view of the door exit device of the present invention.
Figure 2B:
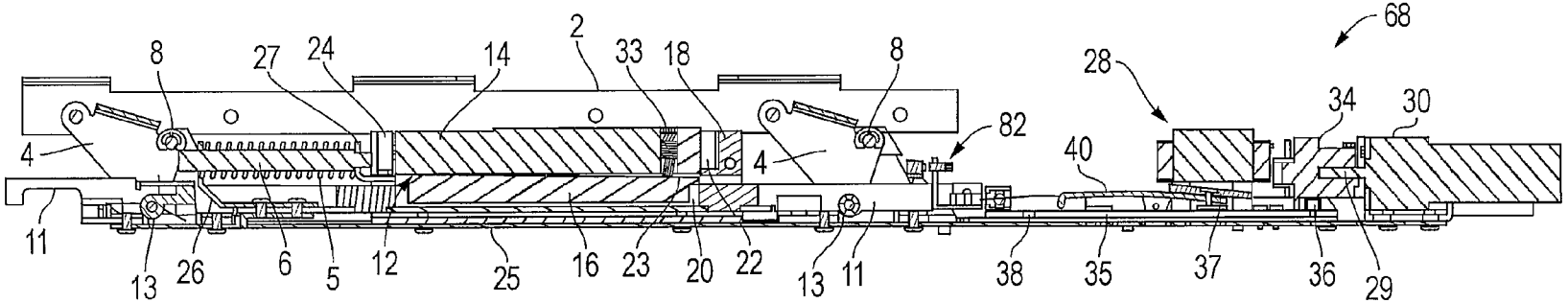
FIG. 2B depicts a second cutaway view of the door exit device of the present invention.

Specifically, FIGS. 2A and 2B illustrate the internal components and assembly of portions of push pad apparatus 10 housed within housing member 3 in accordance with one embodiment of the present invention. As shown in the overhead view of FIG. 2A and the side cutaway view of FIG. 2B, the depicted push pad apparatus includes a mounting plate 25 onto which the housing-encased components are mounted. Mounted on mounting plate 25, the push pad apparatus generally includes an egress enable mechanism comprising a latch retraction assembly operatively coupled to push pad 1 via a push pad chassis 2. The latch retraction assembly is operatively coupled between push pad 1 and latch bolt 15 to release the latch bolt in response to manual actuation of push pad 1.

In accordance with the embodiment depicted in FIGS. 2A and 2B, the latch retraction assembly includes push pad chassis 2 pivotally coupled via a pair of bellcranks 4 to an action rod 11. Action rod 11 is movably mounted relative to mounting plate 25, such that action rod 11 is freely movable lengthwise along the fixed mounting plate 25 in response to push pad chassis 2 moving inwardly toward mounting plate 25.

Action rod 11 is operatively coupled to a spring assembly comprising a push pad return spring 5, a return spring guide 6, and front and rear return spring brackets 26 and 27. Action rod 11 is a substantially rectilinear slide member disposed adjacent mounting plate 25. Front return spring bracket 26 is fixedly connected by mechanical fasteners or otherwise to action rod 11, while rear return spring bracket 27 is fixedly coupled with respect to stationary mounting plate 25. The spring assembly further comprises push pad return spring 5, represented as a helical coil spring in the depicted embodiment. The internal lengthwise axis of push pad return spring 5 is supported around a return spring guide 6 extending between brackets 26 and 27. Front return spring bracket 26 includes an opening though which return spring guide 6 is received and supported and is sized to allow front return spring bracket 26 to slidably move freely along return spring guide 6 coincident with the lengthwise movement of action rod 11. In the depicted configuration, the spring assembly applies a leftward (right-to-left as depicted in FIGS. 2A and 2B) bias to action rod 11 with respect to stationary mounting plate 25.

Referring now to FIG. 1 in conjunction with FIGS. 2A and 2B, retraction or release of latch bolt 15 is achieved by applying a force to urge push pad 1 inwardly toward a door (not depicted) on which push pad apparatus 10 is mounted. The resultant transverse force and movement directly translated from push pad 1 to push pad chassis 2 pivots bellcranks 4 about respective bellcrank support pins 8 in an arc-like motion that translates to a substantially longitudinal resultant force and motion applied to the lower portion of bellcranks 4 at the point of fixture of bellcranks 4 to action rod 11 at respective bellcrank action rod pins 13. The force applied at bellcrank action rod pins 13 urges action rod 11 to move left-to-right in FIGS. 2A and 2B in opposition to the right-to-left bias applied by the spring assembly. While not expressly depicted in the figures, the described manually actuated movement imparted to action rod 11 may be translated by well-understood linkage mechanisms to retract latch bolt 15. It should be noted that while the depicted embodiment comprises a rim latch type latching mechanism, the present invention may encompass other door latch types utilized in alternative exit device designs, such as mortise and vertical rod devices. The retraction of latch bolt 15 allows a door to which push pad apparatus 10 is mounted to be opened. In the foregoing manner, and in response to a force applied to push pad 1 overcoming the resilient elasticity of return spring 5, action rod 11 and front return spring bracket 26 move as a unit rightwardly (with reference to FIGS. 2A and 2B) as urged by the pivoting bellcranks 4, thereby compressing return spring 5 and enabling the mechanical linkage between action rod 11 and latch bolt 15 to retractably release latch bolt 15. Upon subsequent release of push pad 1 from the manual actuation force, push pad 1 and latch bolt 15 return to the extended positions depicted in FIG. 1 as urged by the bias force applied by return spring 5.

The exit device of the present invention further includes a latch retraction locking mechanism that prevents actuation of the above-described manually actuated egress enable mechanism to secure the door on which push pad apparatus 10 is mounted. The latch retraction locking mechanism deployed within the door-mounted push pad apparatus is depicted in FIGS. 2A and 2B as a magnetic lock 12. In accordance with the depicted embodiment, magnetic lock 12 is a solenoid comprising a reciprocating ferromagnetic armature 16 controlled by an electromagnet core 14 and an electromagnet coil 22. A magnet control module (depicted and described with reference to FIGS. 3 and 4) is operatively coupled to the solenoid and utilized to control the reciprocating position and locking status of armature 16.

Magnetic lock 12, comprising electromagnet core 14, electromagnet coil 22, and armature 16, is housed within a magnetic lock housing 31 which is fixedly secured to mounting plate 25. Armature 16 is positioned by the magnetic field generated by electromagnet core 14 and electromagnet coil 22 to disable or otherwise prevent the latch retraction assembly comprising action rod 11 from retracting latch bolt 15. In the depicted configuration, the axis of reciprocal motion for armature 16 is transverse to the longitudinal axis of motion for action rod 11. Armature 16 is a metallic, ferromagnetic member having T-shaped lateral and longitudinal contours in the depicted. In other armature 16 may have other contours, such as rectangular, without departing from the spirit or scope of the present invention. As shown in the lengthwise cutaway view of FIG. 2B, armature 16 loosely fits within a support frame 20 formed as a rectangular cavity within a segment of action rod 11. The lower end of armature 16 rests within support frame 20 when magnetic lock 12 is de-energized. In this unlocked position, the upper cross bar portion of the T-contoured armature 16 remains below a small shear plane opening 23 adjacent a fixedly-disposed blocking end cap 18. In this manner, when magnetic lock 12 is de-energized, blocking end cap 18 poses no barrier to the lengthwise movement of the latch retraction assembly unit comprising armature 16 and action rod 11.

When electromagnet coil 22 is energized, the magnetic field generated by magnetic lock 12 urges armature 16 into an upward locked position. In the locked position, the upper cross-bar end of T-contoured armature 16 is held within a small shear plane opening 23 horizontally adjacent to blocking end cap 18. Blocking end cap 18 is a fixedly coupled member within magnetic lock housing 31 and serves as a barrier to armature 16 and consequently action rod 11 when the armature 16 is in the upwardly extended locked position. When magnetic lock 12 is in the steady state locked mode, action rod 11 is prevented from moving despite an attempted manual actuation of push pad 1, consequently preventing retraction/release of latch bolt 15. In this manner, the latch bolt 15 is held in the extended, latched position as long as power is supplied to magnetic lock 12.

When electromagnet coil 22 is de-energized, armature 16 is released from the magnetic field and magnetic lock 12 is released. As an additional lock release feature, the current/voltage polarity applied to electromagnet coil 22 is briefly reversed prior to de-energizing the coil. The resultant momentary magnetic field reversal urges armature away from the magnet and toward support frame 20 such that the top of armature 16 is removed from its locked position within shear plane 23. To further facilitate return of armature 16 to its unlocked position, magnetic lock 12 includes a spring and plunger assembly 33 biased to urge the upper cross-bar end of armature 16 out of shear plane 23 and toward support frame 20.

Electrical power to magnetic lock 12 and other components of push pad apparatus 10 may be supplied in a variety of conventional ways. Control of the electrical power supplied to electromagnet coil 22 is provided by delayed egress control circuitry that may be housed within and/or outside the door mounted apparatus. In accordance with the fundamental principle of delayed egress secure mode operation, a transition from a locked to an unlocked state of magnetic lock 12 is controlled by a delay timer within the delayed egress control circuitry. The door security system of the present invention distributes the control circuitry between the door mounted apparatus and a remote delay control module, depicted in FIG. 3 as delay control module 58.

The delayed egress control circuitry includes a push pad sensor 82 coupled to mounting plate 25. Push pad sensor 82 is electrically or otherwise communicatively coupled to other components of the delayed egress control circuitry for controlling actuation of magnetic lock 12. Depression of push pad 1 results in a slight movement of push pad 1 toward and in contact with push pad chassis 2, triggering detection of an attempted manual actuation by push pad sensor 82. The detection signal generated by push pad sensor 82 is received by a delay timer within the control circuitry to start a delay period sequence. It should be noted that many sensor designs may be implemented for triggering the delay feature of the delay egress control without departing from the spirit or scope of the present invention.

While in the delayed egress mode, magnetic lock 12 is electrically energized, resulting in armature 16 remaining in a blocking position within shear plane 23 horizontally adjacent to blocking end cap 18. With the upper portion of armature 16 in shear plane 23 and the lower end contained within the support frame 20 portion of action rod 11, action rod 11 remains blocked from lengthwise movement. Applying manual actuation force to push pad 1 triggers push pad sensor 82. In response to detecting an attempt to manually actuate push pad 1, push pad sensor 82 sends a signal to delay control circuitry to commence a delay cycle. The length of the delay cycle is pre-determined in accordance with the competing interests of safety, weighing against an overly protracted delay, and premises security considerations, weighing in favor of a minimally sufficient period to impede an unauthorized egress, and is typically from 15-30 seconds. An alarm is sounded during the delay cycle enabling security personnel to respond to the attempted exit. Upon expiration of the delay cycle, the delayed egress control circuitry interrupts power to magnetic lock 12, freeing action rod 11 to move in response to mechanical actuation of the above-described manually actuated egress enable mechanism. Generally, the delayed egress control circuitry must be manually reset to return to the steady state condition in which magnetic lock 12 is energized to again place action rod 11 in a locked condition.

As further depicted in FIGS. 2A and 2B, push pad apparatus 10 includes a signal actuated latch retraction module 68 that actuates the above-described manually actuated egress enable mechanism in response to an authorized access signal. Latch retraction module 68 generally comprises components for engaging the latch retraction components including action rod 11 to provide alternative latch bolt retraction means when push pad apparatus 10 is operated in an authorized access mode. Latch retraction module 68 includes a motor 30 that, when energized, applies motive retraction force (rightward in the depicted FIGS. 2A and 2B) to a slide assembly 35 which is fixedly coupled to action rod 11. When energized, motor 30 rotates a cylindrical cam 34 mounted to a motor shaft 29. Cylindrical cam 34 engages a follower bushing 36 integrally formed at the end of slide assembly 35. Cylindrical cam 34 is rotated by motor 30 in a direction such that follower bushing 36 is withdrawn in the latch retraction direction (rightward in FIGS. 2A and 2B).

Latch retraction module 68 further includes a temporary latch dogging mechanism comprising a latch 40 pivotally controlled by a magnet 28. Substantially coincident with or during retraction of slide assembly 35, magnet 28 is electrically energized to apply an upward magnetic force on an armature plate 37 fixedly coupled to one end of latch 40. As plate 37 is urged upwardly, the opposing L-shaped lip of latch 40 pivots downwardly against the surface of slide assembly 35 until slide assembly 35 is sufficiently retracted so that the downward L-shaped lip of latch 40 is aligned with and passes into an aperture 38 within slide assembly 35. At this point in the retraction cycle, with latch 40 engaging aperture 38, action rod 11 is sufficiently retracted such that latch bolt 15 is temporarily dogged in the retracted position, enabling access through the door to which push pad apparatus 10 is mounted. As described below, latch retraction module 68 is signal actuated and operates in conjunction with a delayed egress override feature to enable release of latch bolt 15 substantially coincident with receipt of an access authorization signal.

Figure 3:
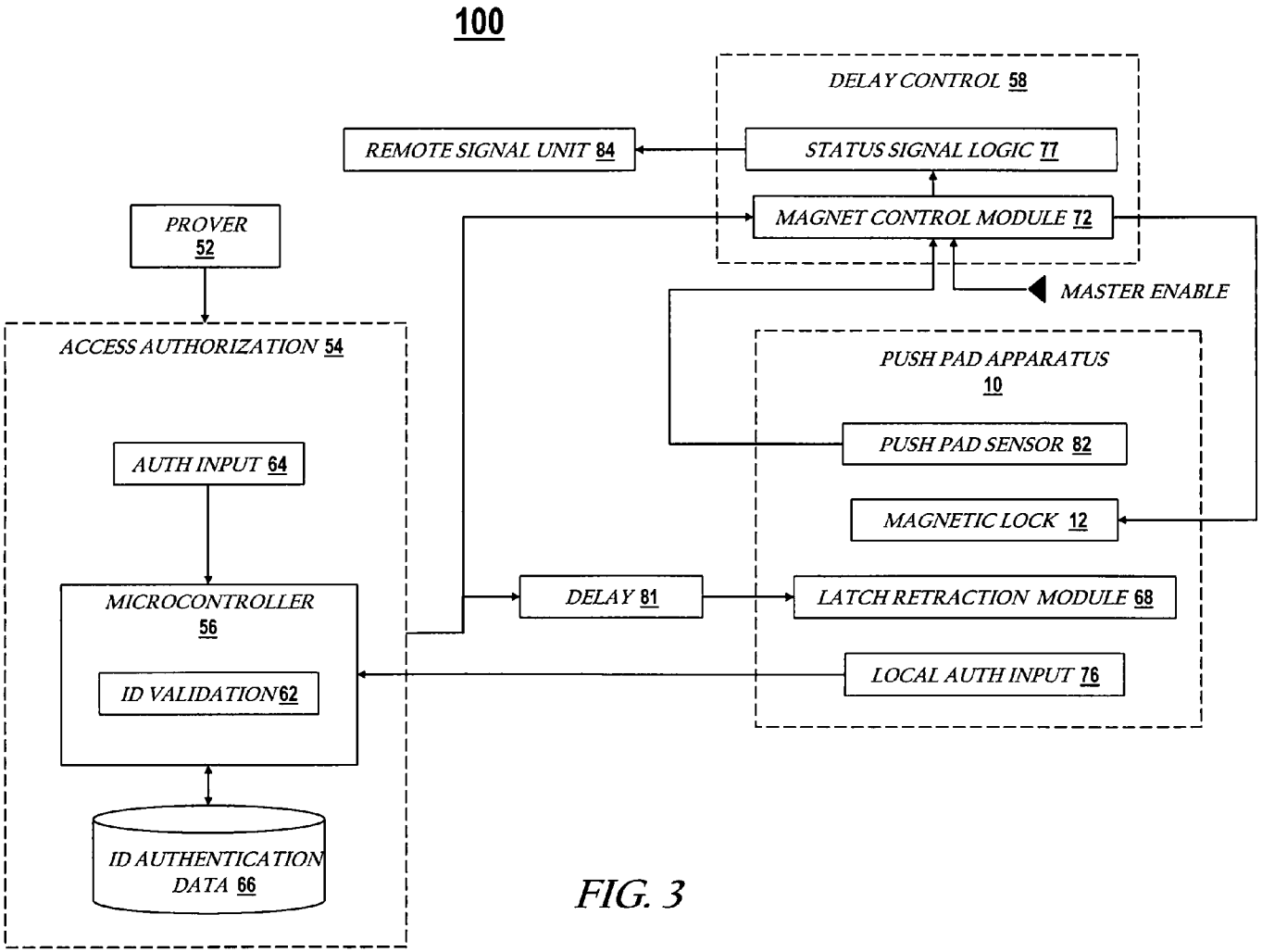
FIG. 3 is a high-level block diagram illustrating a bimodal door security system in accordance with one embodiment of the present invention.

With reference to FIG. 3, there is depicted a high-level block diagram illustrating a bimodal door security system 100 in accordance with the present invention. Door security system 100 enables operation in either a delayed egress mode or an authorized access mode to allow controlled access through a door to which push pad apparatus 10 is mounted. As shown in the depicted embodiment, door security system 100 includes push pad apparatus 10 which, as previously explained, is adapted to be mounted on a door surface. Door security system 100 further comprises a delay control module 58 communicatively coupled to push pad apparatus 10.

As shown in the depicted embodiment, delay control module 58 includes a magnet control module 72 that directly, or indirectly by means of relays or otherwise, delivers power and/or other control signals (referred to alternatively as electrical actuation or electrical control) to magnetic lock 12 to control the locked/unlocked state of magnetic lock 12. During the steady state delayed egress operating mode, magnet control module 72 directly or indirectly provides continuous electrical actuation of magnetic lock 12 to maintain the push pad actuated egress enable mechanism including action rod 11 locked. Magnet control module 72 further includes circuit and/or program instruction modules that, while in the delayed egress operating mode, and responsive to receiving a detection signal from push pad sensor 82, begins a delay cycle to release magnetic lock 12 following a pre-determined delay period commenced upon receipt of the detection signal from push pad 82. The delay cycle period is executed in part by a delay timer circuit (not depicted) contained within magnet control module 72.

The delayed egress system preferably further provides output signal indicia for alerting security personnel of an unauthorized attempt to exit through the door and also to signal the accessibility status of push pad apparatus 10. To this end, door security system 100 further includes audible alarms, visual status indicators and other security and control features collectively represented by remote signal unit box 84. The alarm/indicator functionality comprising remote signal unit 84 is controlled by status signal logic 77, which is communicatively coupled to magnet control module 72. Status signal logic 77 includes logic and circuit means for activating an egress alarm in response to magnet control module 72 detecting, from the sensor input from push pad sensor 82, an unauthorized egress attempt. The alarm generated by remote signal unit 84 may be proximate the location of push pad apparatus 10 or may be transmitted to a remote security monitoring location. Status signal logic 77 further includes logic and circuit means for activating within remote signal unit 84, a visual indication (such as by an indicator light that changes color) of the present egress enablement status (e.g. locked or unlocked) of push pad apparatus 10.

In the depicted embodiment, magnet control module 72 receives a MASTER ENABLE input to ensure that door security system 100 will operate in a fail-safe manner. Specifically, the MASTER ENABLE signal delivers a deactivation signal to magnet control module 72 in response to emergency sensors such as fire alarms. In response to receiving a deactivation signal from the MASTER ENABLE input, magnet control module 72 removes power from magnetic lock 12 such that delayed egress operating mode is disabled and non-delayed manual actuation of the latch retraction assembly within push pad apparatus 10 enabled.

The depicted door security system 100 further includes an access enable device that provides non-delayed signal actuated retraction of latch bolt 15. The signal actuated access enable device operates in concert with a lock override feature of magnet control module 72 that, responsive to receiving said access authorization signal, releases magnetic lock 12 to enable non-delayed retraction of latch bolt 15. Specifically, the access enable mechanism depicted in FIG. 3 includes latch retraction module 68, which is controllably activated in accordance with access authorization performed by an access authorization module 54. Access authorization module 54 is depicted as a microcontroller-based system generally comprising an authorization input device 64 communicatively coupled to a microcontroller 56 that performs access authorization. Input device 64 may be any of a number of identification entry devices including RF or magnetic card readers, alphanumeric code entry pads, biometric readers, etc., that may be located inside and/or outside of the door to which push pad apparatus 10 is mounted. The entry device may be tied to a building security system and monitored at a remote security station.

Input device 64 receives and possibly "reads" the encoded or unencoded information or commands presented by a human or automated prover 52. Microcontroller 56, which is locally or remotely coupled to input device 64 through some form of bus port or other interface, processes the received access information to determine whether or not access will be authorized. In the depicted embodiment, microcontroller 56 utilizes an ID validation module 62 that includes program modules for determining an identification validity status of the received user information in accordance with ID validation data 66.

In response to determining that the access identification input by prover 52 is valid, access authorization module 54 generates and sends an access authorization signal to magnet control module 72. Responsive to receiving the access authorization signal, magnet control module 72 generates and immediately sends, directly or indirectly such as via relay, a signal that removes electrical energization from magnetic lock 12. As a result, armature 16 is released away from shear plane 23 such that the upper cross bar portion of armature 16 is no longer adjacent blocking end cap 18 and action rod 11 may freely move.

The access authorization signal from authorization module 54 is also received by push pad apparatus 10 to effectuate automatic electric retraction of latch bolt 15 just subsequent to release of magnetic lock 12. As depicted in FIG. 3, the authorization signal is slightly delayed by a delay device 81 before being received by latch retraction module 68 such that retraction is commenced following release of magnetic lock 12. Responsive to the authorization signal, the motor-driven latch retraction module 68 engages and retracts slide assembly 35 as described above to retract latch bolt 15 with no substantial delay from the time the input access identification code was entered and validated by access authorization module 54.

Figure 4:
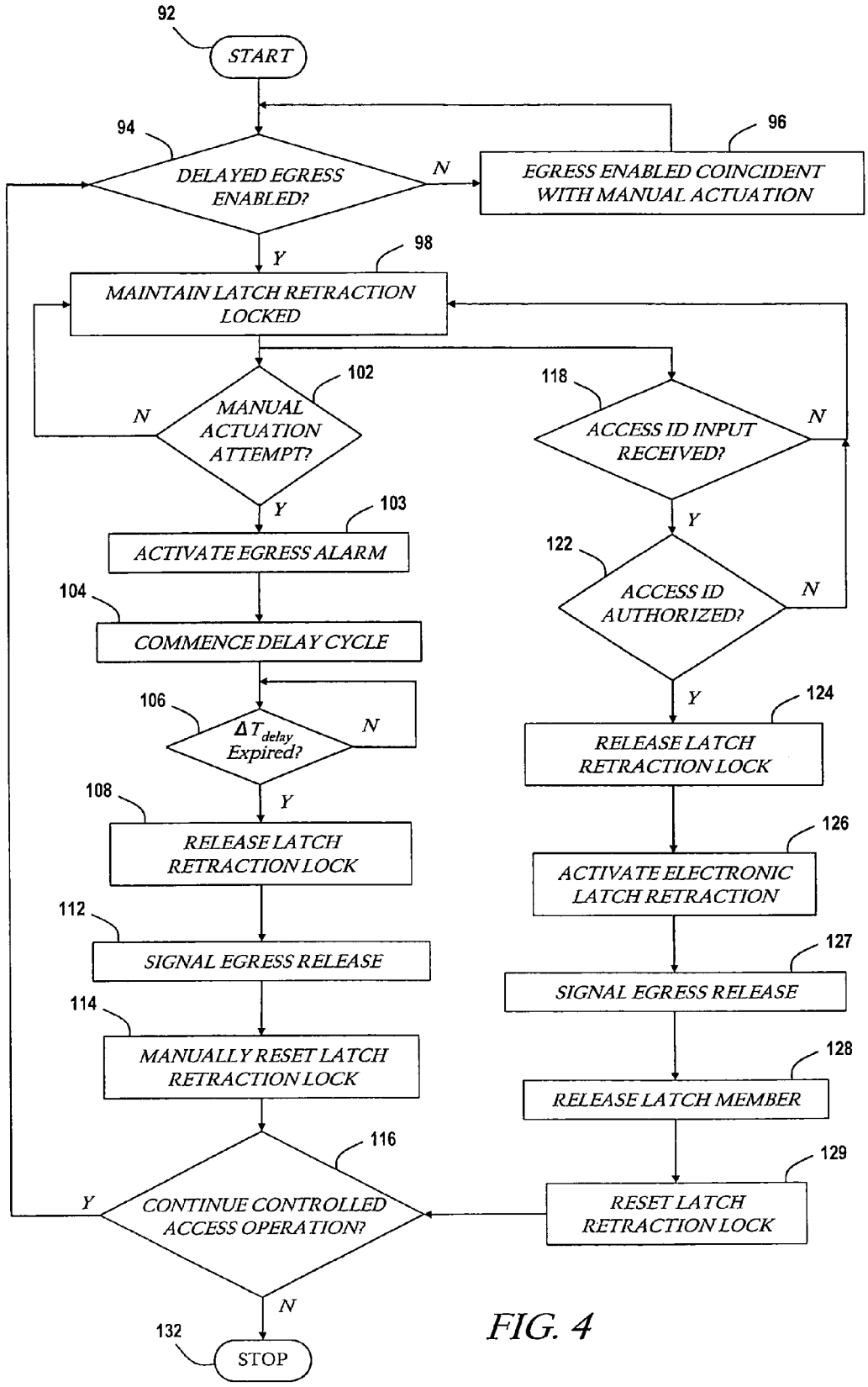
FIG. 4 is a flow diagram depicting steps performed during bimodal security system operation in accordance with the present invention.

With reference to FIG. 4, there is illustrated a flow diagram depicting steps performed by door security system 100 during bimodal access control in accordance with the present invention. Bimodal door access operation begins as illustrated at step 92. If, as shown at steps 94 and 96, delayed egress operation is disabled, such as via the MASTER ENABLE input, magnetic lock 12 remains released, allowing undelayed retraction of latch bolt 15 in response to manual actuation of push pad 1. If the delayed egress operation is enabled, magnetic lock 12 remains continuously activated to prevent retraction of latch bolt 15 coincident to a manual actuation of push pad 1 as depicted at steps 94 and 98.

Proceeding to step 102, push pad sensor 82, in cooperation with magnet control module 72, monitors whether or not an attempt has been made to manually actuate push pad 1. Typically, this monitoring includes sensing whether a push pad travel has been detected for a sufficient period of time (typically a couple of seconds) to constitute an actual attempt to retract latch bolt 15 rather than an incidental contact with push pad 1. In response to detecting an attempt to actuate the push pad, the delayed egress functionality within door security system 100 performs a series of steps for delaying access through the door on which push pad apparatus 10 is mounted and alerting security personnel. Initially, status signal logic 77 activates an egress alarm and a delay cycle is commenced as shown at steps 103 and 104. The system remains in the delay cycle with magnetic lock 12 remaining activated for a pre-determined period $\Delta T_{delay}$ following the detected actuation attempt as illustrated at step 106.

Upon expiration of the delay period, magnet control module 72 releases magnetic lock 12 and visual door status indicia within remote signal unit 84 provides a visual indication, such as by a green door status light, of the unlocked status of push pad apparatus 10 (steps 108 and 112). Magnet control module 72 maintains magnetic lock 12 released before magnetic lock 12 is manually reset as shown at step 114.

In addition to the delayed egress operating mode, bimodal access control of the present invention further includes an authorized access mode in which undelayed and automated retraction of latch bolt 15 is provided for authorized users. Door security system 100 remains in the continuous delayed egress operating mode with magnetic lock 12 remaining locked, until access authorization module 54 generates and sends an access authorization signal to magnet control module 72 and latch retraction module 68. As depicted at steps 118, 122, and 98, access authorization module 54 sends the authorization signal in response to ID validation module 62 validating an access ID input received by authorization input 64. Responsive to the authorization signal, magnet control module 72 releases magnetic lock 12 as depicted at step 124.

Immediately subsequent to the release of magnetic lock 12, motor-driven latch retraction module 68 responds to the slightly delayed authorization signal by retracting slide assembly 35 and consequently retracting latch bolt 15 (step 126). Substantially coincident with activation of latch retraction module 68, visual door status indicia within remote signal unit 84 provide a visual indication, such as by a green door status light, of the unlocked status of push pad apparatus 10 as shown at step 127. Magnet 28 holds latch 40 to maintain the latch retraction assembly comprising action rod 11 in the retracted position for a specified period, typically 15-30 seconds, before the power to magnet 28 is removed to release the assembly and re-extend latch bolt 15 (step 128). Following release of the latch retraction assembly, magnet control module 72 re-enables magnetic lock 12 and re-arms the alarm system as shown at step 129.

As illustrated at steps 116 and 132, bimodal controlled access operations continues until the system is disabled, such as by asserting or de-asserting the MASTER ENABLE input to delay control module 58.

While the invention has been particularly shown and described with reference to a preferred embodiment, it will be understood by those skilled in the art that various changes in form and detail may be made therein without departing from the spirit and scope of the invention.

What is claimed is:

1. A door security system comprising:

a latch bolt;

a stationary mounting plate;

an action rod configured to move freely relative to the stationary mounting plate, the action rod coupled to the latch bolt;

a return spring configured to bias the action rod in a first direction, wherein movement of the action rod in the first direction causes the latch bolt to move to a latched position;

a push pad chassis operably coupled to the action rod, the push pad chassis and action rod configured such that a manual force applied to the push pad chassis urges the action rod in a second direction, the second direction being opposite to the first direction, wherein a movement of the action rod in the second direction causes the latch bolt to move to an unlatched position;

an electromagnet having an electromagnet housing and an armature, the armature configured to engage the action rod when the electromagnet is de-energized, the electromagnet housing fixedly connected to the mounting plate;

wherein when the electromagnet is energized, the armature comes into contact with the electromagnet housing, whereby the electromagnet housing prevents motion of the armature and the action rod and, consequently, maintains the latch bolt in the latched position;

a slide assembly coupled to the action rod; and a motor coupled to the slide assembly, wherein the motor, the slide assembly, and the action rod are configured such that when the motor is energized the motor applies a retraction force to the slide assembly and the action rod, whereby the latch bolt is automatically moved to the unlatched position.

2. The door security system of claim 1, further comprising a housing of the door security system, wherein substantially all of the mounting plate, action rod, return spring, push pad chassis, armature, electromagnet housing, slide assembly, and motor are located in the housing of the door security system.

3. The door security system of claim 1, further comprising a cylindrical cam operably coupled to the slide assembly, wherein a shaft of the motor is configured to operably couple to and operate the cylindrical cam.

4. The door security system of claim 1, wherein the motor and slide assembly are positioned at an end of the action rod that is distal from an end of the action rod that is proximal to the latch bolt.

5. The door security system of claim 4, wherein the action rod is proximal, and the push pad chassis is distal, relative to the mounting plate.

6. The door security system of claim 1, further comprising a latch dogging mechanism configured to engage the slide assembly at an aperture of the slide assembly, and thereby, provide a dogging of the bolt latch in an unlatched position.

7. The door security system of claim 6, wherein latch dogging mechanism is located at an end of the action rod that is distal from the end of the action rod that is proximal to the latch bolt.

8. A door security system comprising:

a latch bolt;

a stationary mounting plate;

an action rod configured to move freely relative to the stationary mounting plate, the action rod coupled to the latch bolt;

a return spring configured to bias the action rod in a first direction, wherein movement of the action rod in the first direction causes the latch bolt to move to a latched position;

a push pad chassis operably coupled to the action rod, the push pad chassis and action rod configured such that a manual force applied to the push pad chassis urges the action rod in a second direction, the second direction being opposite to the first direction, wherein a movement of the action rod in the second direction causes the latch bolt to move to an unlatched position;

a first armature of a first electromagnet, a portion of the first armature received in a cavity of the action rod when the electromagnet is de-energized;

a housing of the first electromagnet fixedly connected to the mounting plate;

wherein when the first electromagnet is energized, the first armature is partially lifted out of the cavity of the action rod and comes into contact with the housing of the first electromagnet, whereby the housing of the first electromagnet prevents motion of the first armature and the action rod and, consequently, maintains the latch bolt in the latched position;

a slide assembly coupled to the action rod; and a motor coupled to the slide assembly, wherein the motor, the slide assembly, and the action rod are configured such that when the motor is energized the motor applies a retraction force to the slide assembly and the action rod, whereby the latch bolt is automatically moved to the unlatched position.

9. The door security system of claim 8, further comprising a housing of the door security system, wherein substantially all of the mounting plate, action rod, return spring, push pad chassis, first armature, first electromagnet, housing of the first electromagnet, slide assembly, and motor are located in the housing of the door security system.

10. The door security system of claim 8, further comprising a cylindrical cam operably coupled to the slide assembly, wherein a shaft of the motor is configured to operably couple to and operate the cylindrical cam.

11. The door security system of claim 8, wherein the motor and slide assembly are positioned at an end of the action rod that is distal from an end of the action rod that is proximal to the latch bolt.

12. The door security system of claim 8, wherein the action rod is proximal, and the push pad chassis is distal, relative to the mounting plate.

13. The door security system of claim 8, further comprising a latch dogging mechanism, the latch dogging mechanism further comprising:

a second electromagnet;

a latch coupled to a second armature of the second electromagnet;

wherein the second electromagnet, the latch, and the second armature are configured such that when the second electromagnet is energized the latch moves to engage the slide assembly at an aperture of the slide assembly, and thereby, provide a dogging of the bolt latch in an unlatched position.

14. The door security system of claim 13, wherein the second electromagnet, the latch, and the second armature are located at an end of the action rod that is distal from the end of the action rod that is proximal to the latch bolt.

15. A door security system comprising:

a latch bolt;

a stationary mounting plate;

an action rod configured to move freely relative to the stationary mounting plate, the action rod coupled to the latch bolt;

a rear return spring bracket fixedly coupled to the stationary mounting plate;

a front return spring bracket fixedly coupled to the action rod;

a return spring interposed between the front return spring bracket and the rear return spring bracket, said return spring configured to bias the action rod in a first direction, wherein movement of the action rod in the first direction causes the latch bolt to move to a latched position;

a push pad chassis;

a pair of bellcranks coupled to the push pad chassis and to the action rod, the push pad, bellcranks, and action rod configured such that a manual force applied to the push pad chassis causes the bellcranks to apply a force to urge the action rod in a second direction, the second direction being opposite to the first direction, wherein a movement of the action rod in the second direction causes the latch bolt to move to an unlatched position;

a first armature of a first electromagnet, a portion of the first armature received in a cavity of the action rod when the electromagnet is de-energized, the first armature spatially positioned between the push pad and the action rod;

a housing of the first electromagnet fixedly connected to the mounting plate, the housing of the first electromagnet having an end cap;

wherein when the first electromagnet is energized, the first armature is partially lifted out of the cavity of the action rod and comes into contact with the end cap, whereby the end cap prevents motion of the first armature and the action rod and, consequently, maintains the latch bolt in the latched position;

a slide assembly coupled to the action rod;

a motor coupled to the slide assembly, wherein the motor, slide assembly, and the action rod are configured such that when the motor is energized the motor applies a retraction force to the slide assembly and the action rod, whereby the latch bolt is automatically moved to the unlatched position;

an access authorization module configured to issue access authorization signals, and wherein in response to the issuance of an access authorization signal the motor is energized to thereby cause a movement of the latch bolt to the unlatched position; and a magnet control module configured to de-energize the first electromagnet in (a) response to the issuance of the access authorization signal and (b) before the motor is energized in response to the issuance of the access authorization signal.

16. The door security system of claim 15, further comprising a housing of the door security system, wherein substantially all of the mounting plate, action rod, front spring return bracket, rear spring return bracket, return spring, push pad chassis, bellcranks, first armature, first electromagnet, housing of the first electromagnet, end cap, slide assembly, and motor are located in the housing of the door security system.

17. The door security system of claim 15, further comprising a cylindrical cam operably coupled to the slide assembly, wherein a shaft of the motor is configured to operably couple to and operate the cylindrical cam.

18. The door security system of claim 17, wherein the motor and slide assembly are positioned at an end of the action rod that is distal from an end of the action rod that is proximal to the latch bolt.

19. The door security system of claim 15, wherein the action rod is proximal, and the push pad chassis is distal, relative to the mounting plate.

20. The door security system of claim 15, further comprising a latch dogging mechanism, the latch dogging mechanism further comprising:

a second electromagnet;

a latch coupled to a second armature of the second electromagnet;

wherein the second electromagnet, the latch, and the second armature are configured such that when the second electromagnet is energized the latch moves to engage the slide assembly at an aperture of the slide assembly, and thereby, provide a dogging of the bolt latch in an unlatched position.

21. The door security system of claim 20, wherein the second electromagnet, the latch, and the second armature are located at an end of the action rod that is distal from the end of the action rod that is proximal to the latch bolt.

* * * * *